US009803946B2

(12) United States Patent
Schoenlau

(10) Patent No.: US 9,803,946 B2
(45) Date of Patent: Oct. 31, 2017

(54) FLASH, NOISE AND SMOKE SUPPRESSION DEVICE

(71) Applicant: William Schoenlau, Huntington Beach, CA (US)

(72) Inventor: William Schoenlau, Huntington Beach, CA (US)

( * ) Notice: Subject to any disclaimer, the term of this patent is extended or adjusted under 35 U.S.C. 154(b) by 0 days.

(21) Appl. No.: 15/061,564

(22) Filed: Mar. 4, 2016

(65) Prior Publication Data

US 2017/0254609 A1 Sep. 7, 2017

(51) Int. Cl.
*F41A 21/30* (2006.01)
*F41A 21/32* (2006.01)
*F41A 21/34* (2006.01)

(52) U.S. Cl.
CPC ..... *F41A 21/32* (2013.01); *F41A 21/30* (2013.01); *F41A 21/34* (2013.01)

(58) Field of Classification Search
CPC ..... F41A 21/32; F41A 21/30; F41A 21/34; F41A 21/28
USPC ..... 89/14.2, 14.4
See application file for complete search history.

(56) References Cited

U.S. PATENT DOCUMENTS 1,736,319 A * 11/1929 Maxim ..... F01N 1/06 181/267
2007/0284178 A1* 12/2007 Scanlon ..... F41A 21/30 180/309

FOREIGN PATENT DOCUMENTS

FR 866.587 * 8/1941

* cited by examiner

*Primary Examiner* — Stephen Johnson
(74) *Attorney, Agent, or Firm* — Flyer & Flyer, a Professional Law Corporation; David R. Flyer

(57) ABSTRACT

The invention is a suppression device to eliminate flash, noise and smoke, collectively "gas" which is created by explosion of a high-powered rifle hammer striking a bullet, from escaping down a barrel of the rifle so as to expose a shooter's location. The device is physically located nearest to the receiver of the rifle. It operates by machine cutting the barrel to form a diverter which directs the gas into a chamber. Inside the chamber are five concentrically and longitudinal arrayed tubes. The gas travels a longer path than the bullet by passing through the tubes, echoing back and forth until dissipation of the gas.

2 Claims, 6 Drawing Sheets

FLASH, NOISE AND SMOKE SUPPRESSION DEVICE

CROSS-REFERENCES

None.

STATEMENT REGARDING FEDERALLY-SPONSORED RESEARCH OR DEVELOPMENT

None.

NAMES OF PARTIES TO JOINT RESEARCH AGREEMENT

None.

REFERENCE TO "SEQUENCE LISTING"

None.

SUMMARY OF INVENTION

Devices that can suppress the flash, noise and smoke associated with the explosion that occurs inside a rifle barrel are useful because the devices assist in concealing the position of a shooter. Typical noise suppression devices rely on the sequentially linear placement of baffles, see for instance US Patent Application Publication No. 2012/0291614 by Koumbis on Nov. 22, 2012, at FIGS. 6, 7 and 8. The problem with these devices is that arrangement of sequential baffles in a row requires a longer device in order to achieve adequate suppression. Other devices rely on nested chambers to dissipate noise, see for instance U.S. Pat. No. 8,286,750 by Oliver on Oct. 16, 2012, and U.S. Pat. No. 8,826,793 by Oliver issued on Sep. 9, 2014. Once again, because the explosion accessed all channels simultaneously, in the patents taught by Oliver, a longer device is required for the same effect.

My invention achieves flash, sound and smoke suppression by a much shorter and lighter device. It comprises of a series of tubes concentrically and longitudinally arrayed within a cylindrical chamber that is slid down a specially dedicated rifle's barrel and threaded onto a rifle's receiver; the receiver is the operating portion of the rifle. The rifle can only be used with my invention, because there is a machined cut into the barrel to divert the flow of gas into the chamber.

When a bullet is fired there is an explosion of gun powder, which is caused by a rifle's hammer striking the bullet within the receiver. The bullet is propelled down the barrel bringing with it escaping gas. The suppression device works by relying on the reflective properties of gas expansion. The gas consists of flash or flame, sound and smoke. The device causes the gas to travel a longer distance within the chamber. With extended travel over time, energy is dissipated, lowering temperature and pressure, which translates into sound loss and slower gas velocity. The key to achieving reduction of flash, noise and sound is to increase the duration of the traveling gas. Flash and smoke will dissipate in a shorter distance than required for the reduction of noise.

As the bullet passes down the barrel by a diverter, the gas is immediately forced into the device's suppression chamber. The diverter is a machined cut into the rifle barrel. The cut means that the rifle must be dedicated to use only with the suppression device. The diverter directs the gas following behind the bullet into the chamber rather than out of the muzzle.

Within the chamber, channels are formed from tubes which are mounted concentrically and held in place at one end by a first grooved plug to accommodate the tubes. There are at least three tubes inserted into the first plug which is at an end nearest to the receiver. A second, grooved plug accommodates at least two tubes and is located at an end farthest from the receiver, and therefore, nearest to a muzzle end of the rifle. The three tubes are fixed in place at the first plug with a slight gap so that they do not touch the second plug, and the two tubes are fixed in place at the second plug with a slight gap so that they do not touch the first plug, which allows the escaping gas to be diverted into the chamber and then to pass back and forth through the tubular channels. The gas reflects backwards and forwards with each approximately 180° turn through the channels, in a fashion similar to sound echoing within canyon walls. It is the passage through the tubes which increases the duration of traveling gas while reducing the overall length of the suppression device. In the above embodiment, there are five tubes. Due to the thinness of the tube walls, there could be seven, nine or eleven tubes mounted inside the chamber.

In another embodiment, the rifle barrel has a threaded end at the muzzle end which can be screwed into a rifle barrel extension. The purpose of the barrel extension is to improve shooting accuracy by adding balance to the weapon and increasing the path of the bullet's travel while guided by the lands and grooves in the barrel extension.

There are five novel and useful features that distinguish my invention from the prior art. First, my rifle barrel has been modified from a standard issue, high-powered rifle, so that the rifle can no longer be used without the suppression device. The reason for this irreversible modification is to enhance the effectiveness of flash, sound and smoke reduction. This is not a "screw-on" device—although, it can be taken apart by unscrewing for cleaning/maintenance purposes—but rather it is an integral part of the system for the reduction of flash, sound and smoke caused by the explosion of gunpowder.

Second, the chamber is a closed system. Other than the entry at the diverter, there is no exit. The gas bounces back and forth only in the chamber.

Third, the suppression device is located nearest the rifle's receiver so as to begin the dampening of flash, sound and smoke closest to its source. By placing the device nearest to the receiver, better balance for purposes of aiming accuracy is achieved, since the weight is closest to the shooter's hand grips. Further, with a shorter suppression chamber there is less overall weight which also improves shooting accuracy.

Fourth, the invention functions by back pressure forcing the gas to travel a much longer physical path than the bullet. The gas is channeled into and contained in a maze of tubes inside the chamber, where the gas is forced to repeatedly reverse direction resulting in dissipation. Essentially, each inch of length of the at least five tubes within the chamber creates at least five inches of travel for the gas. Therefore, my invention can achieve dissipation of flash, noise and smoke with a much shorter chamber.

And fifth, a barrel extension is an option. Any noise suppression device will decrease the velocity of the bullet and the related accuracy achieved by a high speed bullet. The barrel extension option seeks to recover some of the loss in accuracy by providing rifling lands and grooves for a longer period of time in the flight of the bullet.

DETAILED DESCRIPTION OF DRAWINGS

Figure 1:
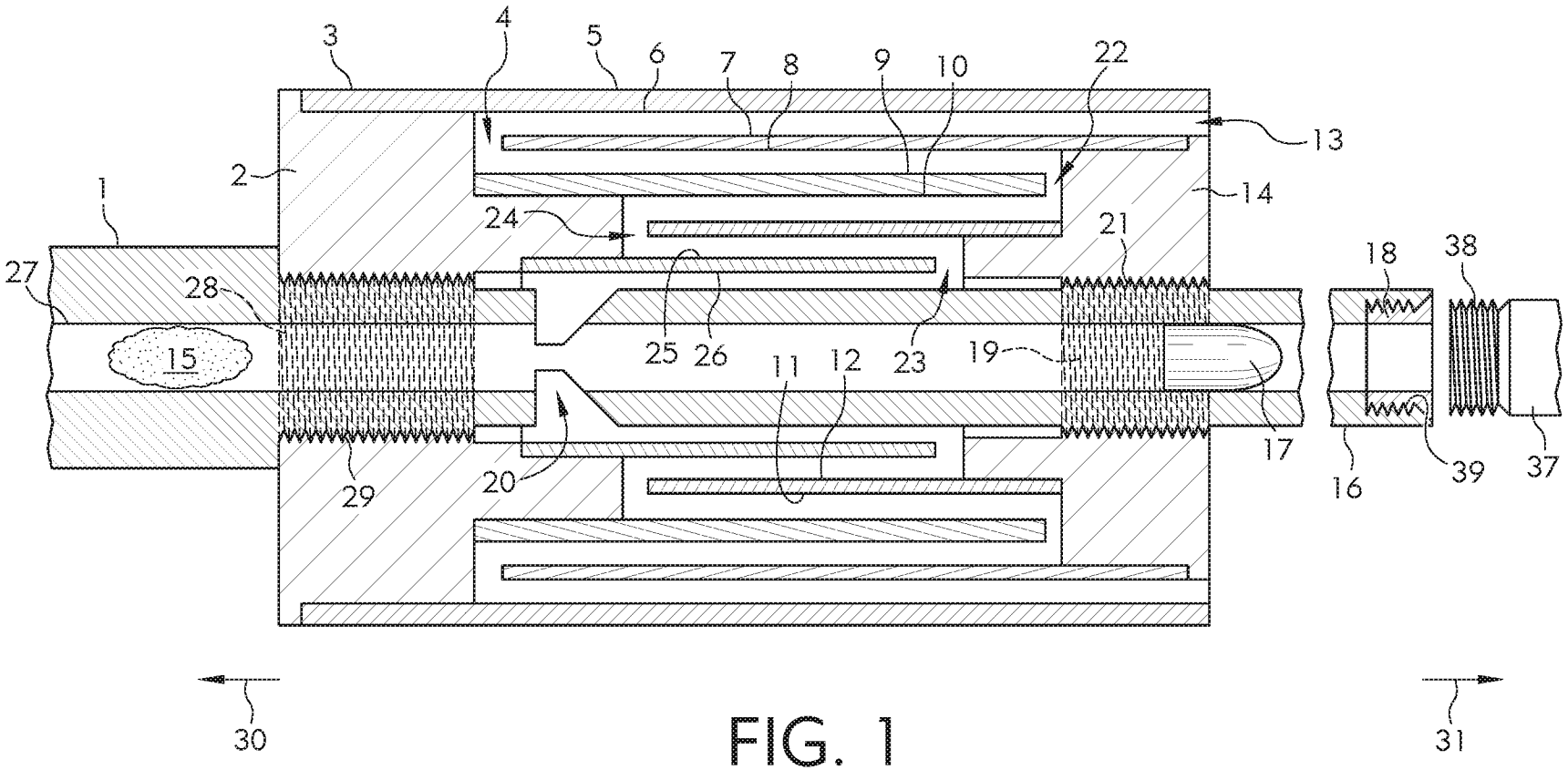
FIG. 1 is a prospective view of the suppression device mounted onto a high-powered rifle receiver.

In FIG. 1, we show a suppression device #3 that has been slid down a high-powered rifle's barrel #1 and affixed to a rifle's receiver #30.

Figure 2:
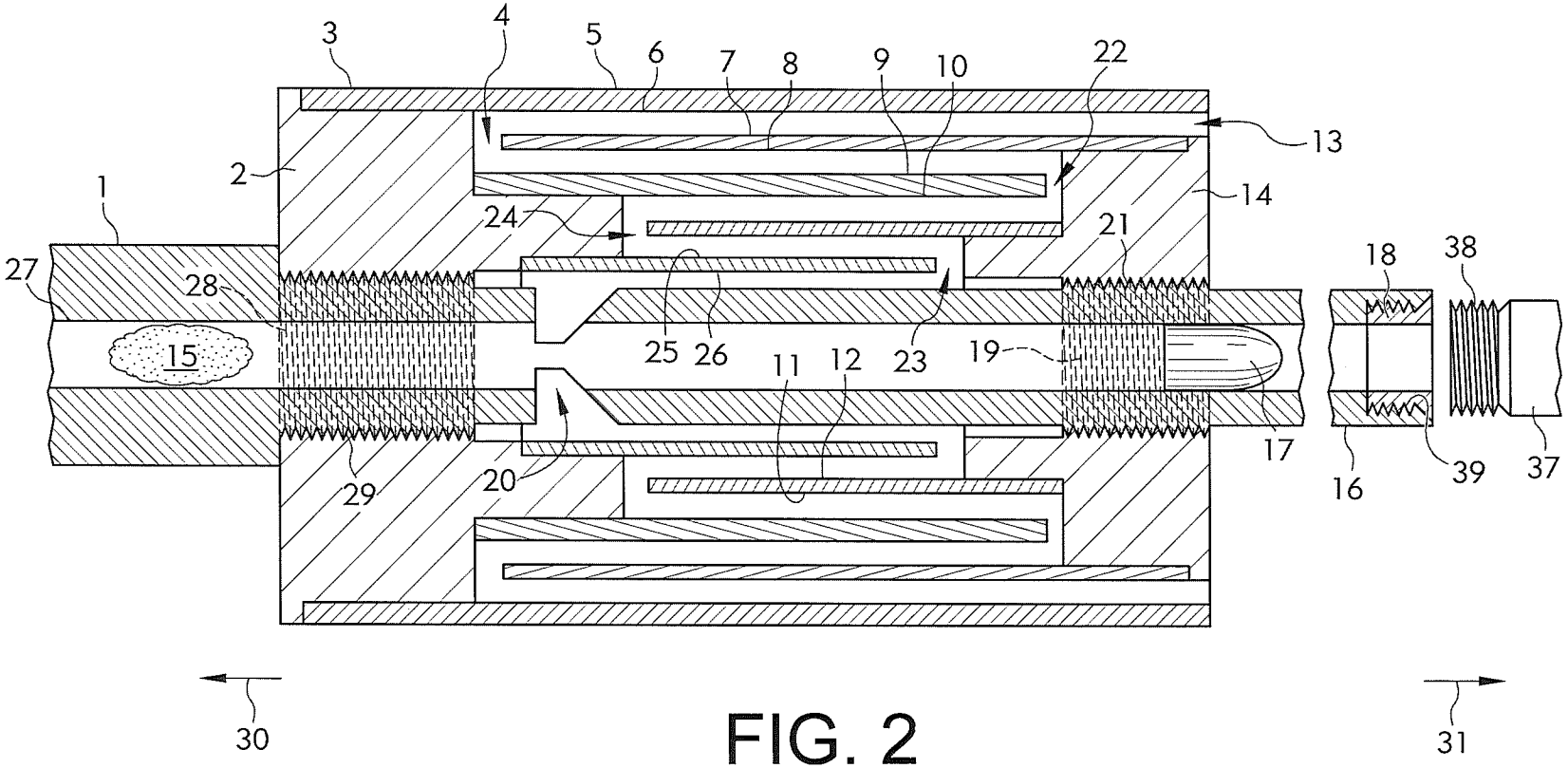
FIG. 2 is a cross-sectional plan view of the suppression device chamber.

In FIG. 2, a cross-sectional view of the suppression device's #3 inner chamber is shown where the device is slid down the rifle barrel #1. When a bullet #17 is fired from the rifle, flash, smoke and noise #15 are generated from an explosion of gun powder. The purpose of the suppression device #3 is to eliminate as much as possible the unwanted flash, noise and smoke #15 to conceal the shooter.

The flash, noise and smoke form a gas which has the highest concentration nearest to the explosion. Dissipation of the gas is inversely related to distance of travel. Therefore, the preferred location for the suppression device's #3 chamber is as near as practicable to the rifle's receiver #30. The receiver contains the firing pin which triggers the explosion of a bullet cartridge's gun powder. To improve sound suppression and increase accuracy a rifle barrel extension #37 as shown in Replacement Sheets FIGS. 2 and 3, with threads #38 at an end nearest to the end of the rifle barrel #16, which can then be screwed onto the threads #39 at the end of the barrel #16 which is farthest from the receiver #30 and nearest to the muzzle #31. When the extension is not being used, a thread protector #18 prevents thread damage. Extension of the barrel allows the remaining gas behind the bullet to travel a longer path, further reducing noise, and importantly making up for loss of accuracy by causing the bullet to spin for a longer period of time.

Figure 6:
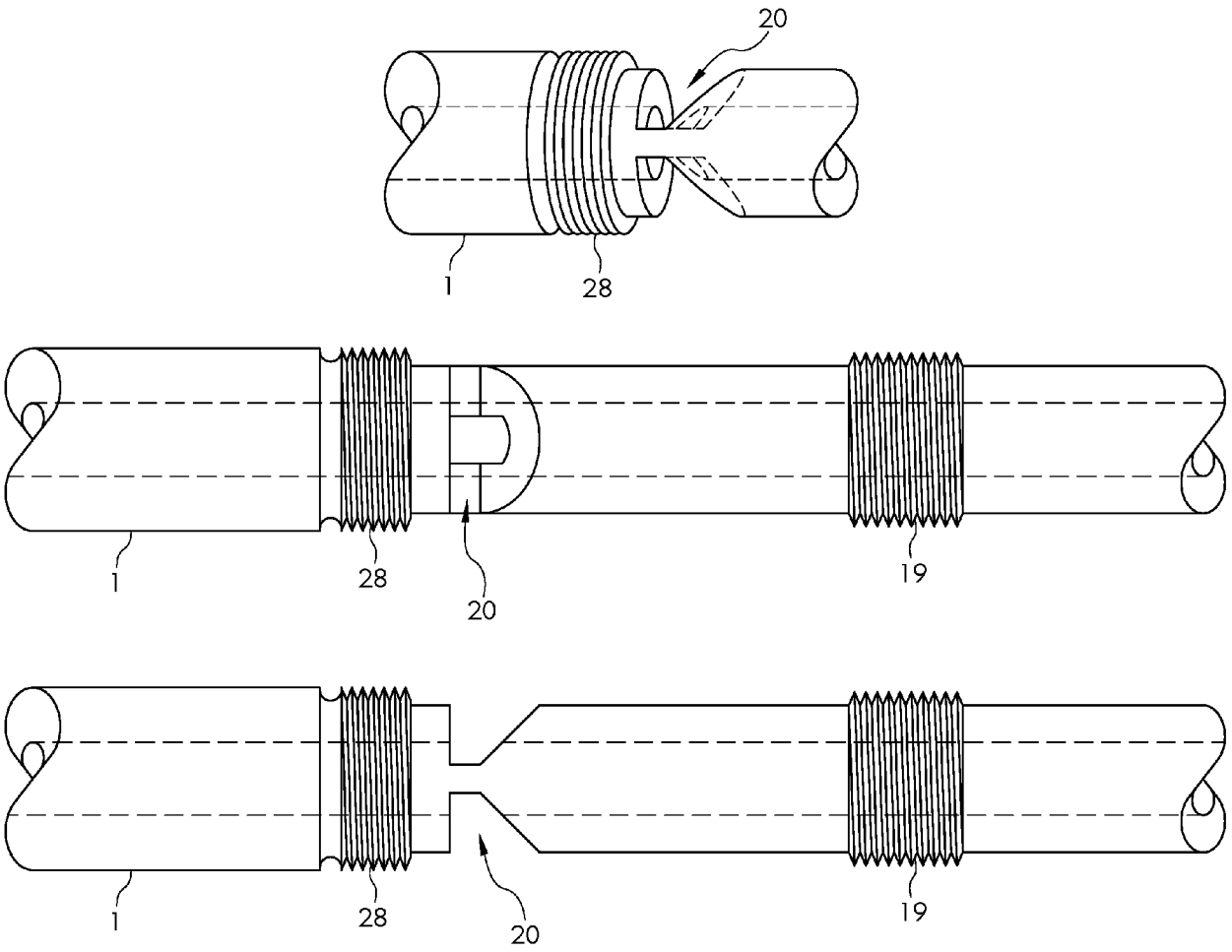
FIG. 6 contains three views. The bottom view is a plan view of the portion of the rifle barrel containing the diverter. The middle view shows the same view rotated 90°. The top view shows the same rotated another 30°.

The gas is forced #15 in the interstitial space #4, 13, 22, 23, and 24 by back pressure at a diverter #20 and directed into a maze created by concentrically arrayed tubes. The diverter #20 is simply a machined cut into the rifle barrel #1, also see the three drawings at FIG. 6.

Figure 5:
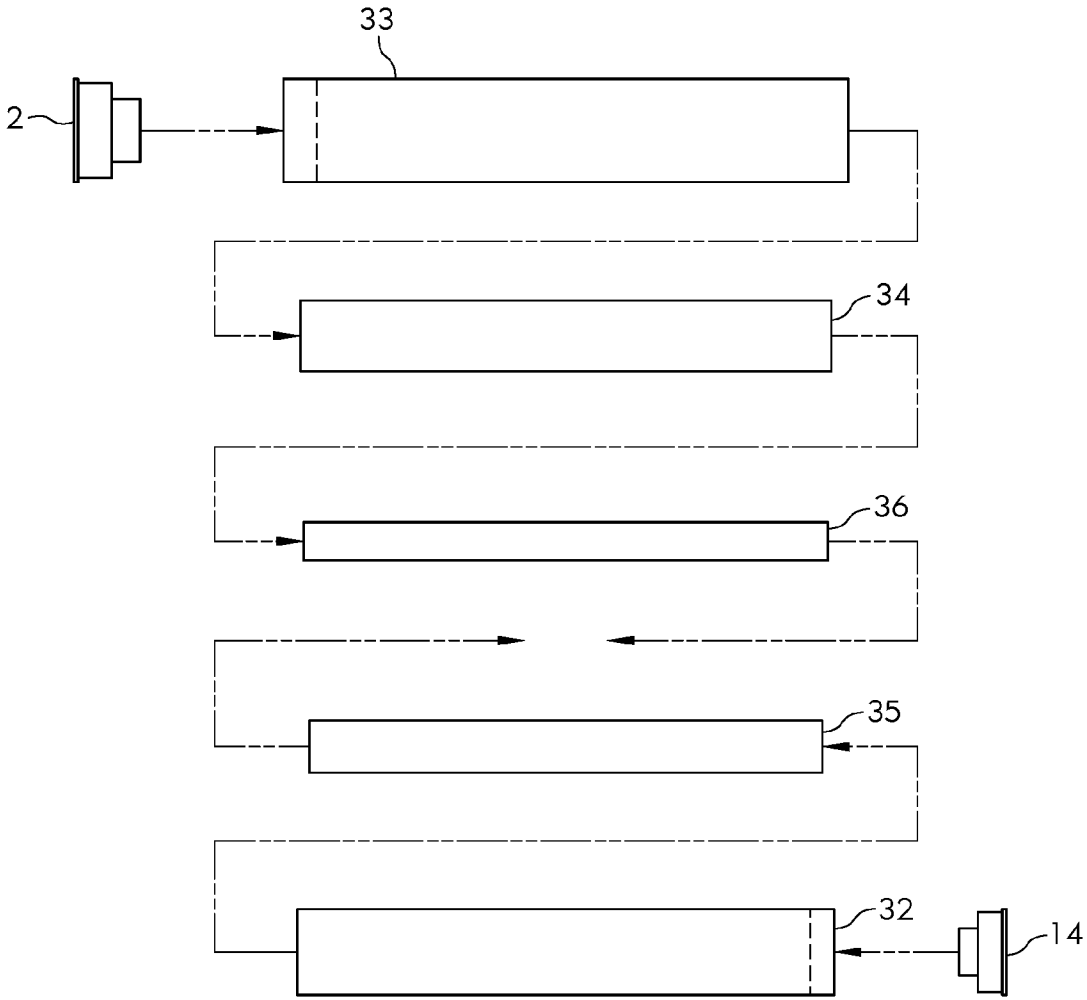
FIG. 5 is a plan view of same showing the decreasing diameters of the at least five concentrically arrayed tubes in relation to the two plugs.

Comparing FIG. 2 and FIG. 5, a first plug #2 is attached to the rifle barrel #1 near the receiver by means of threads #28 where reverse threads #29 are cut into the barrel. The threads permit removal of the suppression device for cleaning and maintenance. On the barrel towards the muzzle end #31, the barrel has threads which are designed to mate with reverse threads #21 cut into the barrel. A maze is located within the suppression device's #3 chamber, which is created by concentrically and longitudinally arrayed tubes or cylinders.

In FIG. 2 and FIG. 5, the device's #3 chamber contains two plugs #2 and #14 at opposing ends. A first plug #2 nearest the receiver #30 holds three tubes #33, 34 and 36, while a second plug #14 nearest the muzzle end #31 holds two tubes #32 and 35. An outer tube wall #5 of the suppressor also serves as the outer tube wall of a first tube #33 and an inner tube wall #6 of the first tube further defines the first tube. The first tube #33 is press fitted in the first plug #2. The first tube does not touch the second plug #14; instead there is a slight gap #4 between the end of the first tube and the second plug.

A second tube #32 is defined by an outer tube wall #7 and an inner tube wall #8. The second tube is press fitted into the second plug #14. There is a slight gap #4 between the end of the second tube #32 and the first plug #2. An interstitial space #13 exists between the first and second tubes. The gas travels within this space.

A third tube #34 is defined by an outer tube wall #9 and an inner tube wall #10. The third tube is press fitted into the first plug #2. There is a slight gap #22 between the end of the third tube #34 and second plug #14. An interstitial space #13 exists between the second and third tubes. The gas travels within this space.

A fourth tube #35 is defined by an outer wall #11 and an inner wall #12. The fourth tube is press fitted into the second plug #14. There is a slight gap #24 between the end of the fourth tube and the first plug #2. An interstitial space exists between the third and fourth tubes. The gas travels within this space.

A fifth tube #36 is defined by an outer wall #25 and an inner wall #26. The fifth tube is press fitted into the first plug #2. There is a slight gap #23 between the end of the fifth tube and the second plug #14. An interstitial space exists between the fourth and fifth tubes. The gas travels within this space. There could be seventh, ninth, or eleventh tubes, alternatively affixed to either the first or second plugs, in other embodiments.

Figure 3:
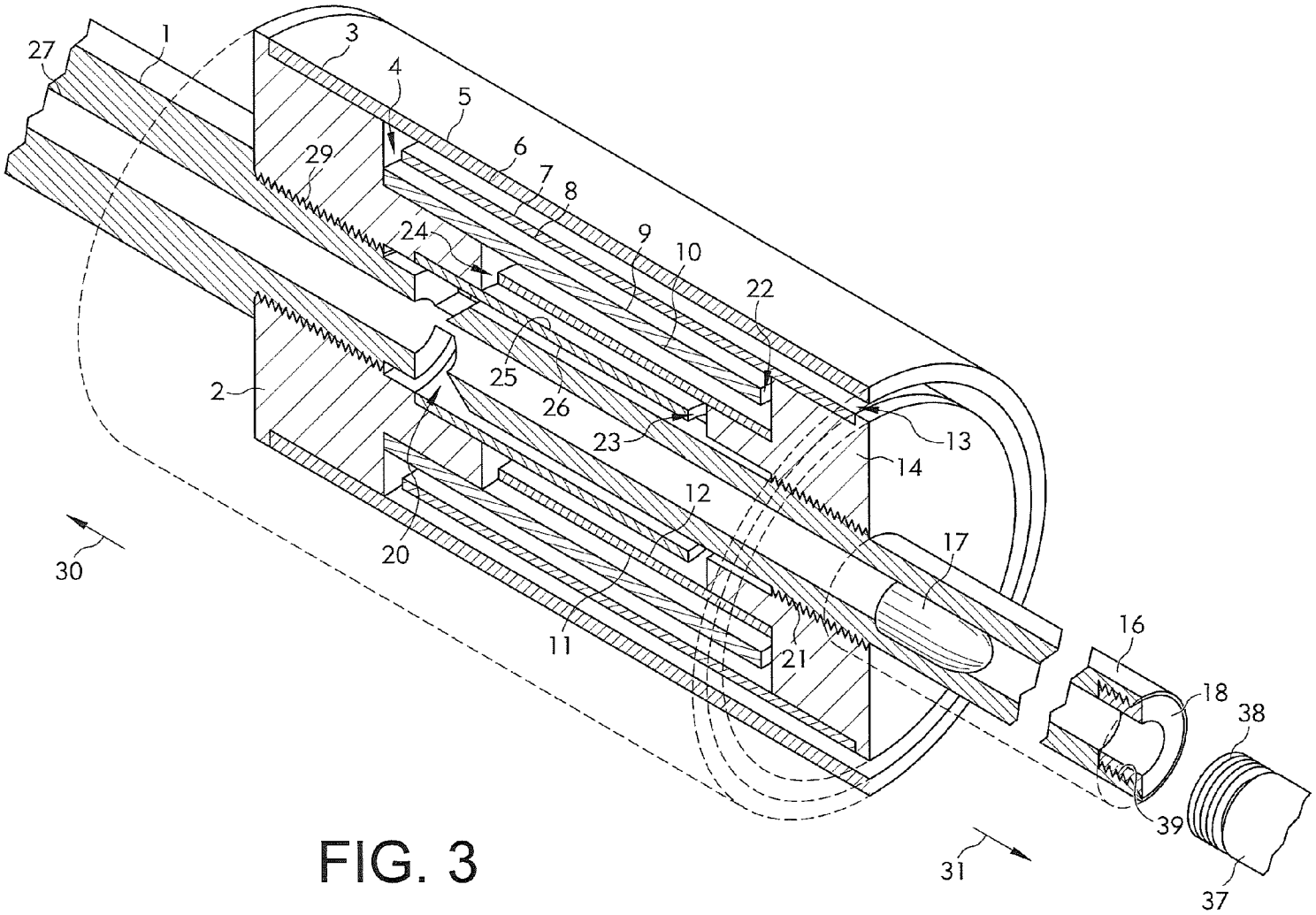
FIG. 3 is a view with the muzzle end of same being raised about 45°.
Figure 4:
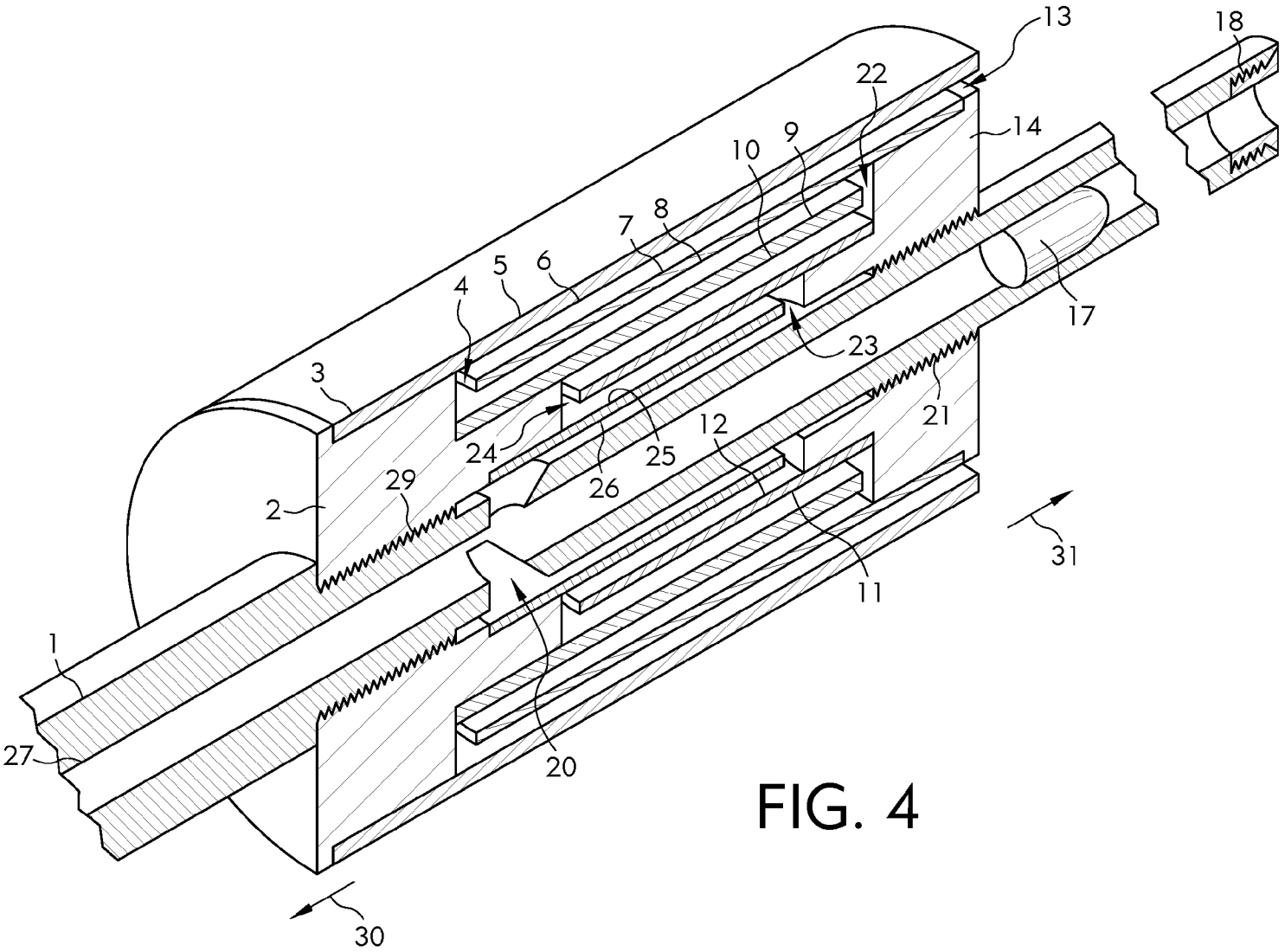
FIG. 4 is a view with the muzzle end of same being tilted backward about 30°.

FIGS. 3 and 4 are perspective views which are provided to show the spatial relationship of the component parts.

The above description of the preferred embodiment of the invention has been presented for the purposes of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims.

The invention claimed is:

1. A flash, noise and smoke suppression device comprising:

a rifle barrel which has a machined cut at an end nearest to a receiver of a high-powered rifle, which serves as a diverter;

where the device is essentially cylindrical in shape and contains a chamber, with an inner side, into which the rifle barrel is inserted so that the chamber slides down as close as possible to the receiver and is then screwed into place;

where the chamber of the suppressor has two opposing ends, within which are five concentrically and longitudinally arrayed tubes;

where there are at least three tubes of the five tubes held in place by a first plug which is connected to an end of the chamber located nearest to the receiver with a slight gap at the opposing end that is located nearest to a muzzle of the rifle barrel, and at least two tubes of the five tubes held in place by a second plug which is at an end of the chamber located nearest to the muzzle with a slight gap at the opposing end that is located nearest to the receiver; and where the first and second plugs of the suppressor are machined with threads that can be reversely threaded onto threads cut into the rifle barrel to affix the suppression device's chamber onto the barrel so that when a bullet is fired any flash, noise and smoke behind the bullet will be diverted into the chamber.

2. The device of claim 1, where the rifle barrel is threaded at a muzzle end and a barrel extension is reversely threaded so that the barrel extension can be screwed onto the muzzle end of the rifle barrel.

* * * * *